US009864302B2

(12) United States Patent
Morishita

(10) Patent No.: US 9,864,302 B2
(45) Date of Patent: Jan. 9, 2018

(54) IMAGE FORMING APPARATUS

(71) Applicant: KYOCERA Document Solutions Inc., Osaka (JP)

(72) Inventor: Hiroki Morishita, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/294,905

(22) Filed: Oct. 17, 2016

(65) Prior Publication Data

US 2017/0139351 A1 May 18, 2017

(30) Foreign Application Priority Data

Nov. 17, 2015 (JP) ..... 2015-224489

(51) Int. Cl.
*G03G 15/08* (2006.01)

(52) U.S. Cl.
CPC ..... *G03G 15/0881* (2013.01); *G03G 15/0898* (2013.01); *G03G 2221/1648* (2013.01)

(58) Field of Classification Search
CPC ..... G03G 15/0881; G03G 15/0817; G03G 15/0898; G03G 2221/1648
See application file for complete search history.

(56) References Cited

U.S. PATENT DOCUMENTS 6,115,565 A * 9/2000 Noda ..... G03G 21/007 399/102
9,146,496 B2 9/2015 Yonemoto
2002/0028086 A1* 3/2002 Sato ..... G03G 15/0898 399/103
2003/0235429 A1* 12/2003 Sato ..... G03B 21/18 399/111
2004/0208668 A1* 10/2004 Kurihara ..... G03G 21/1832 399/102
2006/0239724 A1* 10/2006 Fuwazaki ..... G03G 15/0812 399/284
2006/0291895 A1* 12/2006 Fukuta ..... G03G 15/0812 399/103
2007/0223958 A1* 9/2007 Mori ..... G03G 15/0896 399/103
2008/0075500 A1* 3/2008 Kawata ..... G03G 21/0011 399/102

FOREIGN PATENT DOCUMENTS

JP 2014-109592 A 6/2014

* cited by examiner

*Primary Examiner* — Carla Therrien
(74) *Attorney, Agent, or Firm* — Studebaker & Brackett PC

(57) ABSTRACT

An image forming apparatus includes a rotatable image carrier, a development device and a seal member. The seal member is provided on a downstream side in a rotating direction of the image carrier beyond the development device. The seal member is configured to prevent toner from leaking into a downstream side space in the rotating direction through toner image non-forming areas. The seal member has an elastic member and a slide member. The elastic member has an opposed surface and an end surface. The opposed surface faces the toner image non-forming area. The end surface goes around into a direction separating from the development device from an upstream side end of the opposed surface in the rotating direction. The slide member is provided along the opposed surface and the end surface. The slide member is configured to come in contact with the toner image non-forming area.

6 Claims, 7 Drawing Sheets

IMAGE FORMING APPARATUS

INCORPORATION BY REFERENCE

This application is based on and claims the benefit of priority from Japanese Patent application No. 2015-224489 filed on Nov. 17, 2015, the entire contents of which are incorporated herein by reference.

BACKGROUND

The present disclosure relates to an image forming apparatus including a seal member sealing toner scattered from a developing device.

An electro-photographic image forming apparatus is provided with a rotatable photosensitive drum, and a developing device and a transferring unit disposed in the order along a rotating direction of the photosensitive drum. As the photosensitive drum rotates, a toner image is formed on the photosensitive drum by the developing device and is transferred by the transferring unit from the photosensitive drum onto a recording medium such as an intermediate transferring belt.

In such image forming apparatus, there is a case where toner scattered from the developing device goes around into a space on a downstream side in the rotating direction of the photosensitive drum beyond the transferring unit from both side end portions in a rotating shaft direction of the photosensitive drum. In a case where a static eliminator removing residual electric charge of the photosensitive drum is provided on the downstream side in the rotating direction beyond the transferring unit, if the toner gone around into the space adheres both end portions of the static eliminator in the rotating shaft direction, a quantity of eliminating light is reduced, causing a problem that an eliminating effect degrades.

Then, there is a case where a seal member made of elastic member such as foaming urethane is used to prevent the scattered toner from leaking out of the both end portions of the photosensitive drum in the rotating shaft direction.

As shown in FIG. 7A, the seal member 100 has a two-layered structure of a slide member 101 and an elastic member 102. The slide member 101 is configured to come in contact with toner image non-forming areas on the both end portions of the photosensitive drum 110 in the rotating shaft direction. The elastic member 102 is configured to press the slide member 101 against the toner image non-forming area. The two-layered structure makes it possible to reduce a damage on the intermediate transferring belt because side edges of the intermediate transferring belt abuts with the elastic members 102 when the intermediate transferring belt meanders.

However, when the seal member 100 as described above is used, there is a case where a friction between the toner image non-forming area and the slide member 101 increases depending on surface property of the toner image non-forming area of the photosensitive drum 110, and the slide member 101 may be pulled in the rotating direction of the photosensitive drum 110. Then, as shown in FIG. 7B, the elastic member 102 is pulled by the slide member 101 and comes into contact with the surface of the photosensitive drum 110, causing a problem in which abnormal noise is generated.

SUMMARY

In accordance with an embodiment of the present invention, an image forming apparatus include a rotatable image carrier, a development device and a seal member. The development device is configured to form a toner image on the image carrier. The seal member is provided on a downstream side in a rotating direction of the image carrier beyond the development device. The seal member is configured to prevent toner from leaking into a downstream side space in the rotating direction through toner image non-forming areas outside of a toner image forming area of the image carrier. The seal member has an elastic member and a slide member. The elastic member has an opposed surface and an end surface. The opposed surface is configured to face the toner image non-forming area. The end surface is configured to go around into a direction separating from the development device from an upstream side end of the opposed surface in the rotating direction. The slide member is provided along the opposed surface and the end surface. The slide member is configured to come in contact with the toner image non-forming area.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to figures, an image forming apparatus according to an embodiment of the present disclosure will be described.

Figure 1:
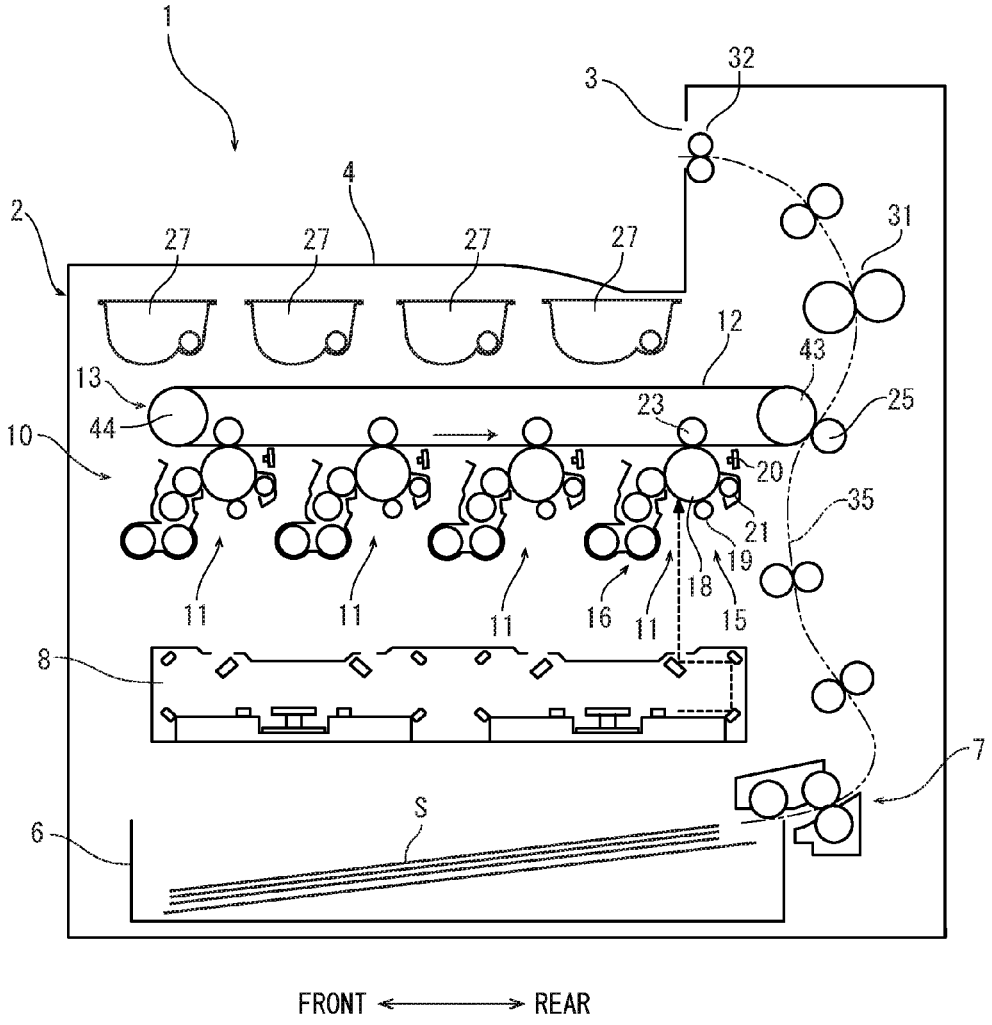
FIG. 1 is a sectional view schematically showing an internal structure of a color printer according to one embodiment of the present disclosure.

First, with reference to FIG. 1, an entire structure of a color printer 1 as an image forming apparatus will be described. FIG. 1 is a perspective view schematically showing the color printer. In the following description, a left side of FIG. 1 shows a front side of the color printer, and left and right directions are based on a direction viewed the color printer from the front side.

The color printer 1 has an apparatus main body 2 of a substantially rectangular parallelepiped shape. On the upper face of the apparatus main body 2, a sheet ejecting port 3 through which a sheet formed with an image is ejected and an ejected sheet tray 4 disposed under the sheet ejecting port 3. In the lower part of the apparatus main body 2, a sheet feeding cartridge 6 configured to store a sheet S is attachably and detachably supported and a sheet feeding device 7 configured to feed the sheet S from the sheet feeding cartridge 6 is provided. Above the sheet feeding cartridge 6, an exposure device 8 is disposed. Above the exposure device 8, a toner image forming part 10 configure to form an image in a photographic manner using toner of four colors is provided.

The toner image forming part 10 has four image forming units 11 and an intermediate transferring unit 13. The four image forming units 11 are arranged under the intermediate transferring unit 13 in the front and rear directions. The image forming unit 11 has a drum unit 15 and a development unit 16. The drum unit 11 is constituted by a photosensitive drum 18 configured to be rotatable around a rotating shaft, as an image carrier, and a charger 19 and a static eliminator 20 and a cleaning device 21 which are disposed around the photosensitive drum 18 in the rotating direction of the photosensitive drum 18. On both side end portions of the photosensitive drum 18 in the rotating shaft direction, toner image non-forming areas R where no toner image is formed are provided (refer to FIG. 2). The photosensitive drum 18 is an amorphous silicon photosensitive drum. The intermediate transferring unit 13 has an endless intermediate transferring belt 12 which circularly travels and four first transferring rollers 23 disposed in the hollow space of the intermediate transferring belt 12. The first transferring roller 23 is rotatably supported so as to face the photosensitive drum 18 of each drum unit 15. Between the photosensitive drum 18 and the intermediate transferring belt 12, a first transferring part 24 is formed.

On the rear side of the toner image forming part 10, a second transferring roller 25 is rotatably supported so as to face the intermediate transferring belt 12. Between the second transferring roller 25 and the intermediate transferring belt 12, a second transferring part 26 is formed. Above the toner image forming part 10, toner containers 27 corresponding to the development units 16 are provided.

Above the second transferring roller 25, a fixing device 31 is provided. Above the fixing device 31, a sheet ejecting part 32 is formed inside of the sheet ejecting port 3. Inside of the apparatus main body 2, a sheet conveying path 32 is formed from the sheet feeding device 7 toward the sheet ejecting part 32 through the second transferring part 26 and the fixing device 31.

Next, the operation of forming an image by the color printer 1 having such a configuration will be described. In each of the drum units 15, after a surface of the photosensitive drum 18 is charged by the charger 19, the exposure device 8 exposes the surface of the photosensitive drum 18 with a laser light based on an image date to form an electrostatic latent image on the surface of the photosensitive drum 18. The electrostatic latent image is then developed into a toner image of corresponding color by the development unit 16. The toner image formed on the photosensitive drum 18 is transferred on the intermediate transferring belt 12 at the first transferring part 24. The above operation is performed by the image forming units 11 to form a full color toner image on the intermediate transferring belt 12. Residual charge and toner are removed by the static eliminator 20 and the cleaning device 21, respectively.

On the other hand, the sheet S fed from the sheet feeding cartridge 6 by the sheet feeding device 7 is conveyed along the sheet conveying path 35 in a suitable timing with the above image forming operation. Then, at the second transferring part 26, the full color toner image on the intermediate transferring belt 12 is second-transferred on the sheet S. The sheet S on which the toner image is second-transferred is conveyed on the downstream side along the sheet conveying path 35 and enters the fixing device 31 and then, the full color toner image is fixed on the sheet S in the fixing device 31. The sheet with the fixed toner image is ejected from the sheet ejecting port 32 by the sheet ejecting part 32 onto the ejected sheet tray 4.

Figure 2:
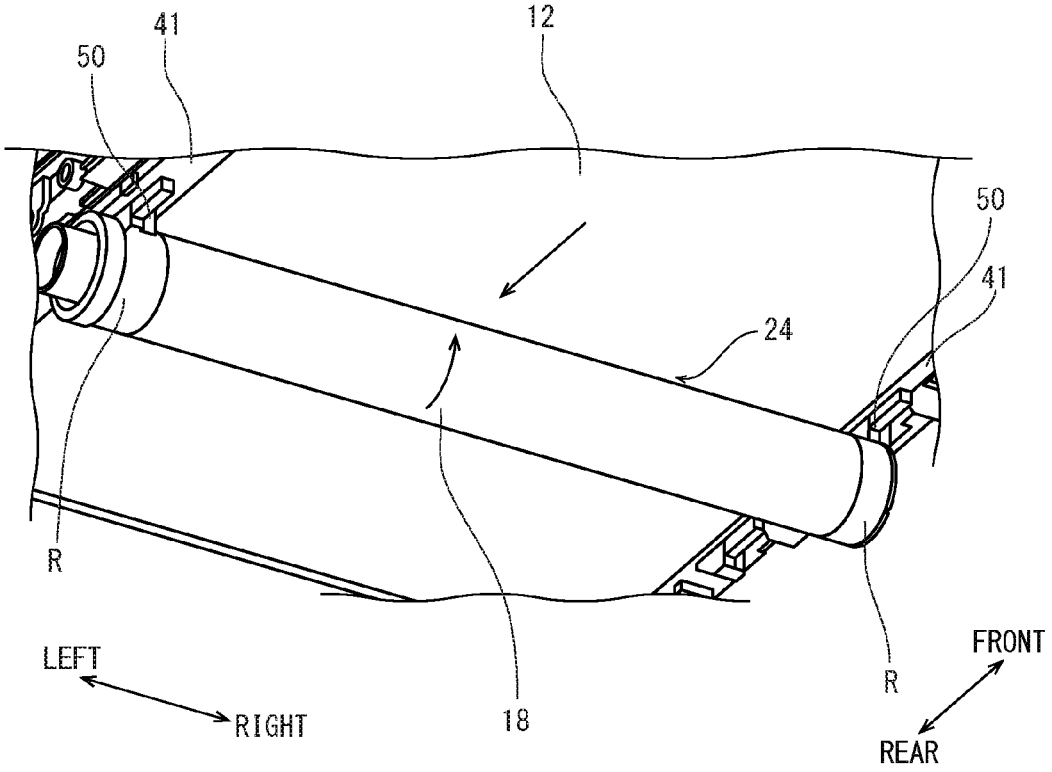
FIG. 2 is a perspective view showing a side end portion of an image forming unit in a rotating shaft direction of a photosensitive drum, which is reversed upside-down, in the color printer of one embodiment of the present disclosure.
Figure 3:
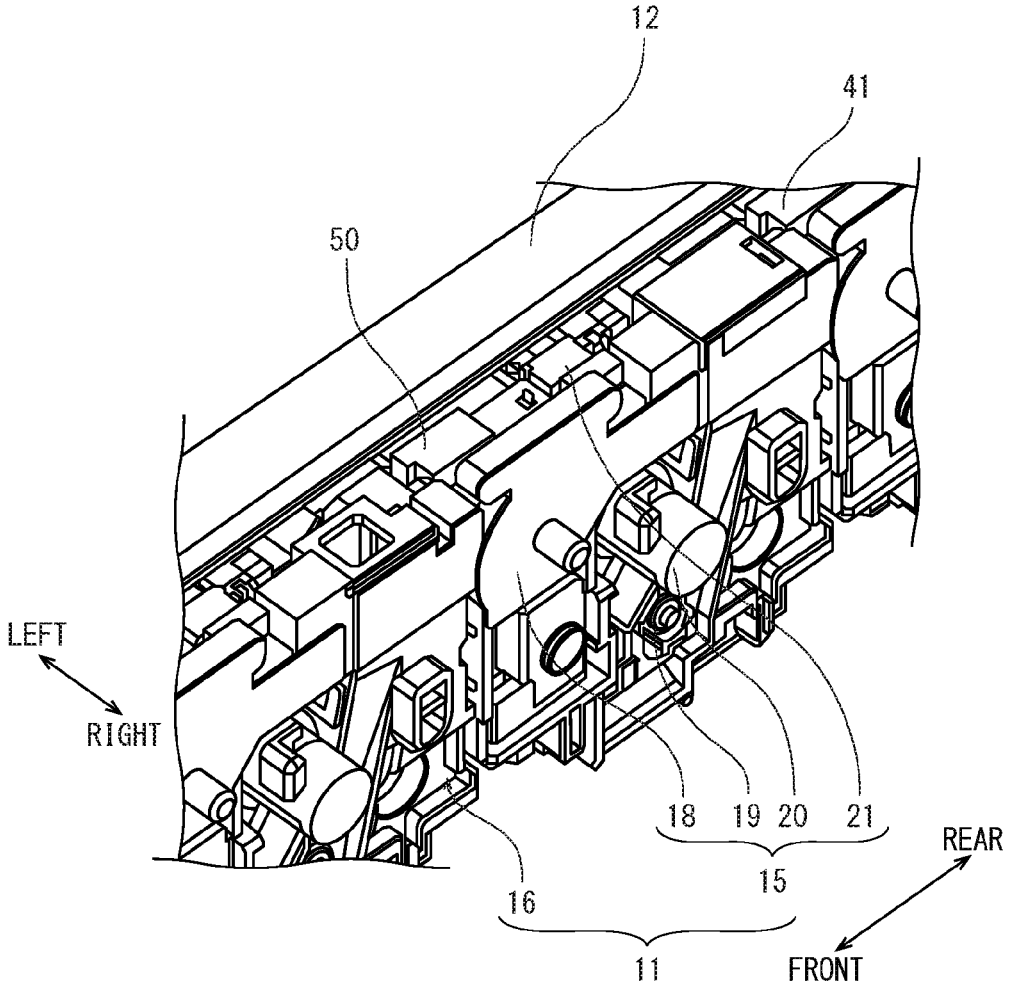
FIG. 3 is a perspective view showing the photosensitive drum and an intermediate transfer unit viewed from a lower side, in the color printer of one embodiment of the present disclosure.

Next, the intermediate transferring unit 13 and the image forming unit 11 will be described with reference to FIGS. 1, 2 and 3. FIG. 2 is a perspective view showing the photosensitive drum and the intermediate transfer unit which are reversed upside-down and FIG. 3 is a perspective view showing a side end portion of the image forming unit in the rotating shaft direction of the photosensitive drum.

The intermediate transferring unit 13 includes a pair of side plates 41 (refer to FIG. 2), a driving roller 43 and a driven roller 44, as shown in FIG. 1. The pair of side plates 41 face with each other in a width direction of the intermediate transferring belt 12. The driving roller 43 is rotatably supported between one end portions (the rear end portions) of the pair of side plates 41. The driven roller 44 is rotatably supported between the other end portions (the front end portions) of the pair of side plates 41. The intermediate transfer belt 12 is wound around the driving roller 43 and the driven roller 44 and circularly travels in a predetermined direction (a counterclockwise direction in FIG. 1) as the driving roller 43 rotates. The first transferring rollers 23 are rotatably supported between the pair of side plates 41.

As shown in FIG. 2, the pair of side plates 41 are disposed outsides in the width direction of the intermediate transferring belt 12 so as to face the toner image non-forming areas R formed on the both side end portions in the rotating shaft direction of the photosensitive drum 18. On lower surfaces of the pair of side plates 41, a seal member 50 is attached in front of each first transferring part 24 in the traveling direction of the intermediate transferring belt 12.

Figure 4:
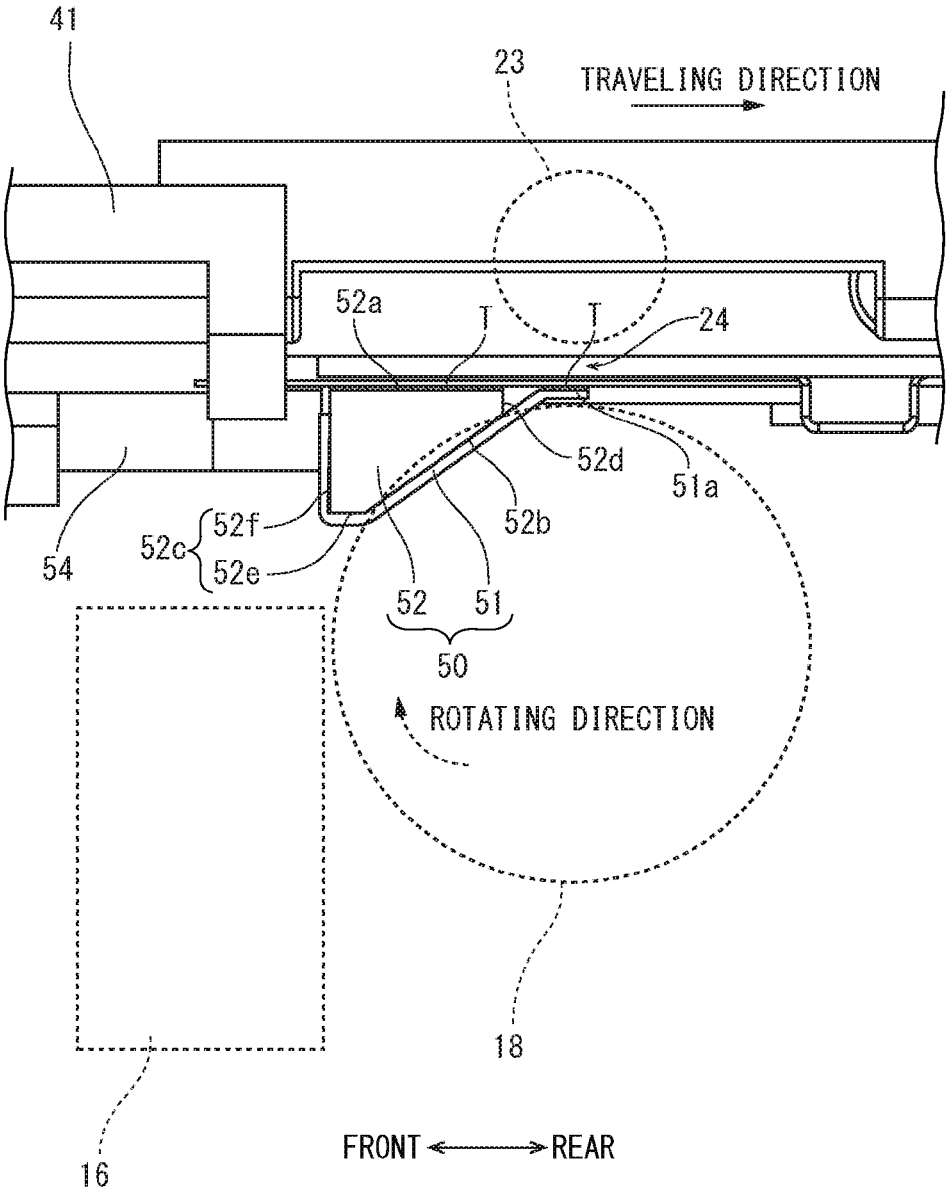
FIG. 4 is a view showing a seal member, in the color printer of one embodiment of the present disclosure.
Figure 5:
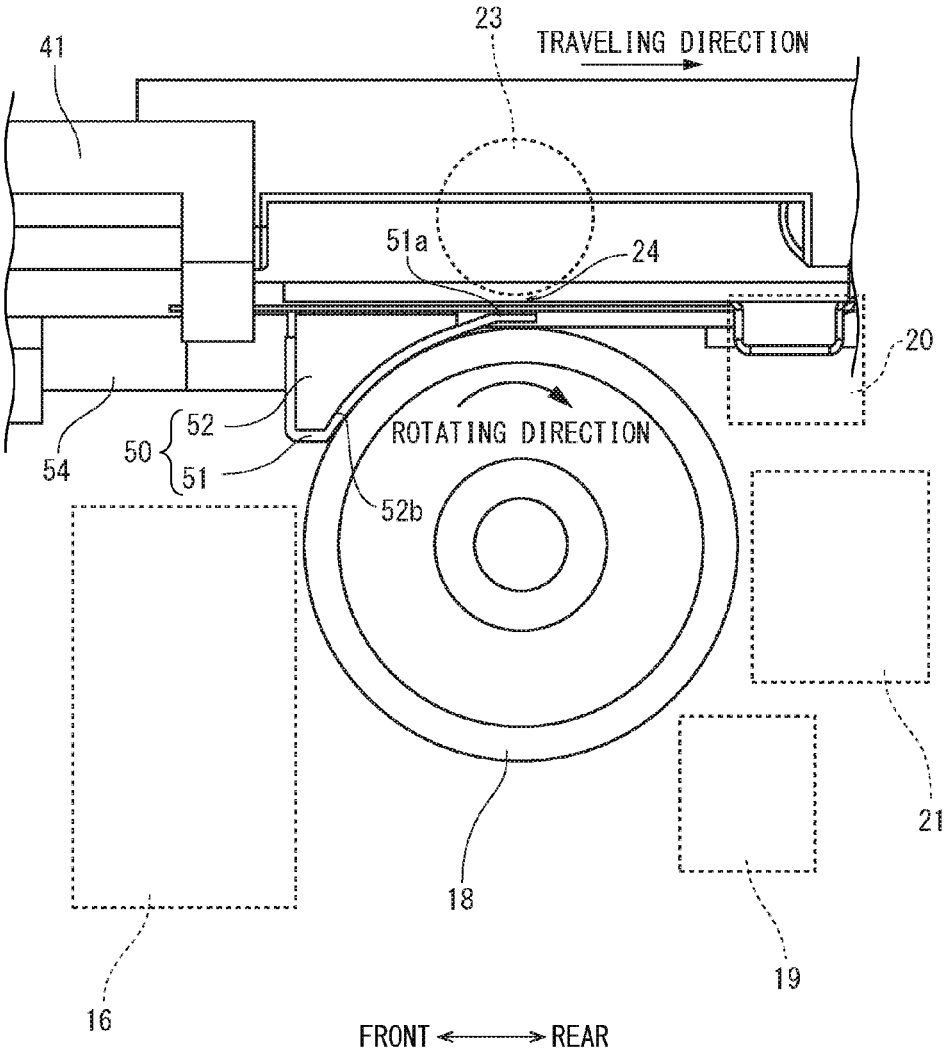
FIG. 5 is a view showing the seal member when the image forming unit is attached, in the color printer of one embodiment of the present disclosure.
Figure 6:
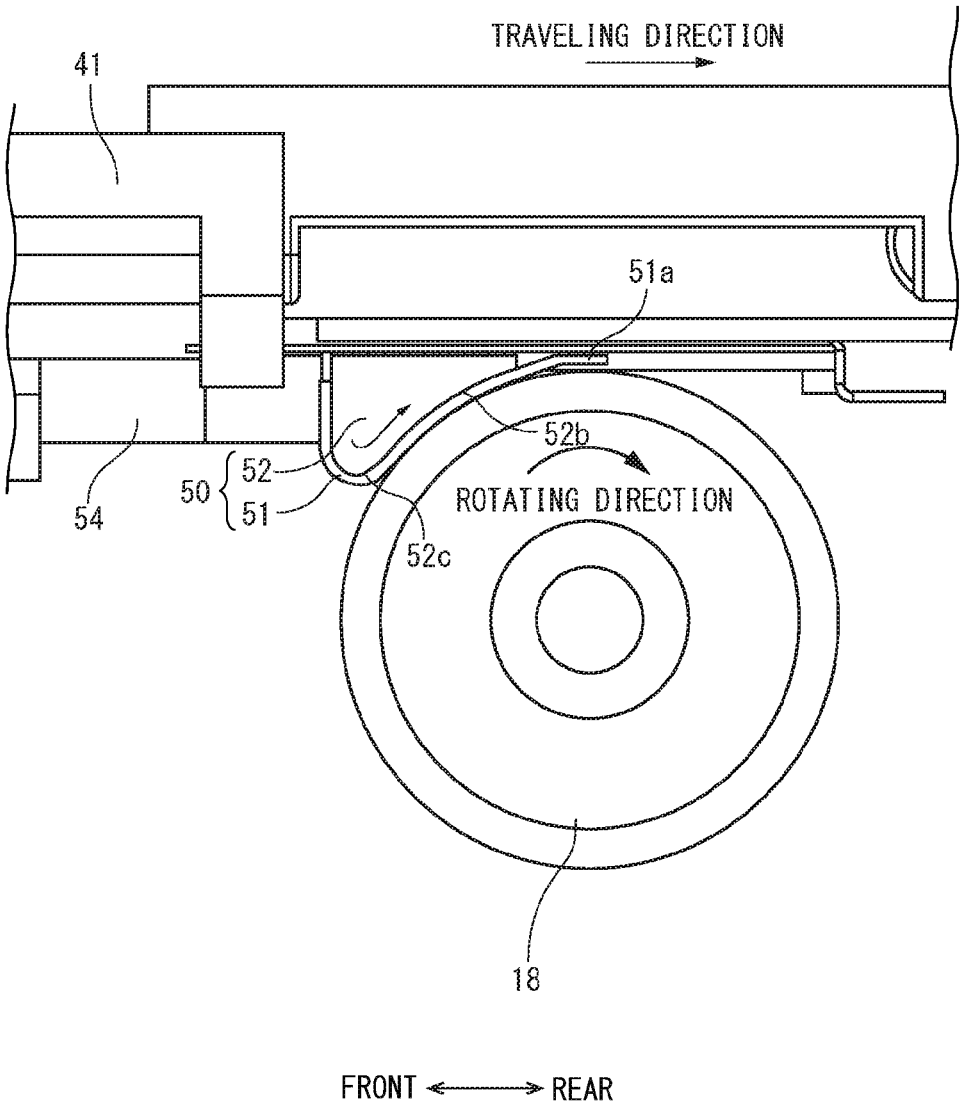
FIG. 6 is a view showing the deformed seal member, in the color printer of one embodiment of the present disclosure.
Figure 7A:
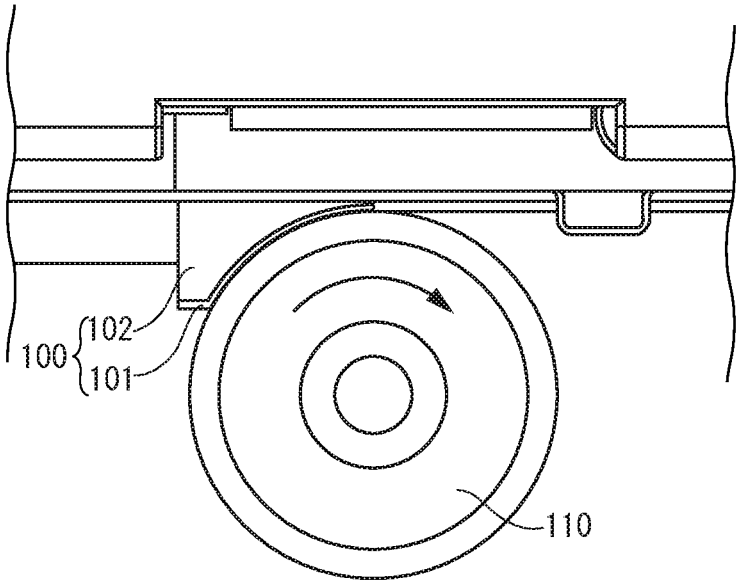
FIG. 7A is a view showing a conventional seal member when an image forming unit is attached.
Figure 7B:
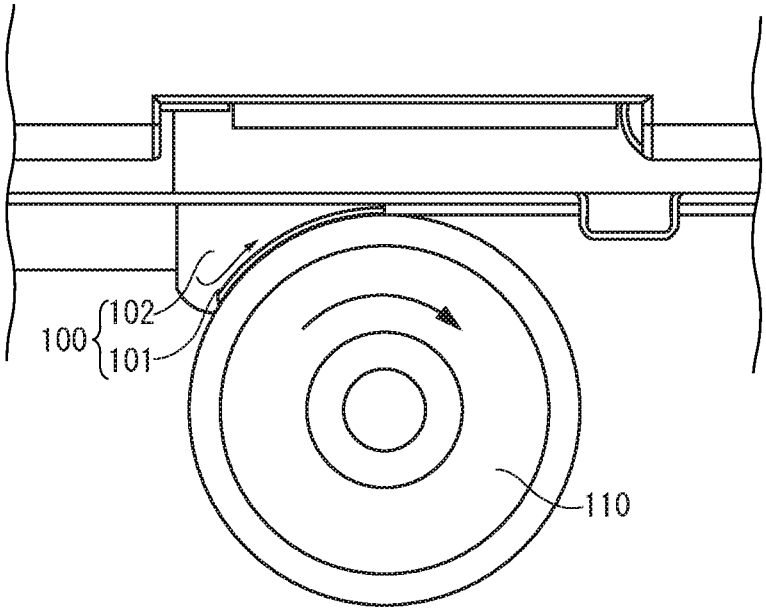
FIG. 7B is a view showing the deformed conventional seal member.

The seal member 50 will be described with reference to FIG. 2 and to FIGS. 4 through 6. FIG. 4 shows the seal member 50, FIG. 5 shows the seal member when the image forming unit is attached, and FIG. 6 shows the deformed seal member.

As shown in FIG. 2, the seal member 50 seals a space between the toner image non-forming area R of the photosensitive drum 18 and the side plate 41 between the development unit 16 and the first transferring part 24. As shown in FIG. 4, the seal member 50 has a two-layered structure of a slide member 51 and an elastic member 52. The slide member 51 is configured to come in contact with the toner image non-forming area R. The elastic member 52 is configured to press the slide member 51 against the toner image non-forming area R.

The elastic member 52 is formed into an approximately into an inverse trapezoidal shape in a side view, as shown in FIG. 4, with a width narrower than a width of the side plate 41 of the intermediate transferring unit 13. The elastic member 52 has an attachment surface 52*a*, an opposed surface 52*b*, an upstream side end face 52*c* and a downstream side end surface 52*d*. The attachment surface 52*a* is configured to be attached to the lower surface of the side plate 41. The opposed surface 52*b* is configured to face the toner image non-forming area R. The upstream side end surface 52*c* is configured to be formed between an upstream side end (lower end in FIG. 2) of the opposed surface 52*b* in the rotating direction and an upstream side end of the attachment surface 52*a* in the rotating direction. The downstream side end surface 52*d* is configured to be formed between a downstream side end (upper end in FIG. 2) of the opposed surface 52*b* in the rotating direction and a downstream side end of the attachment surface 52*a* in the rotating direction. The upstream side end surface 52*c* is formed so as to go around in a direction separating from the developing unit 16 with respect to the opposed surface 52*b*. Thus, the elastic member 52 is formed so as to be decreased in height toward the downstream side in the rotating direction of the photosensitive drum 18.

The opposed surface 52*b* is formed so as to be inclined in an upper oblique direction toward the downstream side in the rotating direction of the photosensitive drum 18. The upstream side end surface 52*c* includes a parallel surface 52*e* and a vertical surface 52*f*. The parallel surface 52*e* is formed from the upstream side end of the opposed surface 52*b* in the rotating direction in parallel with the attachment surface 52*a* in a direction separating from the photosensitive drum 18. The vertical surface 52*f* is vertically formed upward from a farthest tip end from the photosensitive drum 18 in the parallel surface 52*e* to the attachment surface 52*a*. Thus, the vertical surface 52*f* intersects with the attachment surface 52*a* at approximately right angles and the extended line of the vertical surface 52*f* intersects with the extended line of the opposed surface 52*b* with an acute angle. The elastic member 52 is made of elastic material such as silicon sponge.

The slide member 51 is a tape-like member and is fixed along the opposed surface 52*b* and the upstream side end surface 52*c* of the elastic member 52. The downstream side end 51*a* of the slide member 51 in the rotating direction of the photosensitive drum 18 extends on the downstream side in the rotating direction of the photosensitive drum 18 beyond the downstream side end surface 52*d* of the elastic member 52. Hereinafter, the extended downstream side end 51*a* will be called as an extension part. The slide member 51 is made of material such as PTFE felt. The slide member 51 is fixed with the elastic member 52 by means of adhesion using an adhesive agent or a double-sided tape, of heat sealing or the like.

The seal member 50 is fixed to the side plate 41 such that the attachment surface 52*a* of the elastic member 52 is fixed on the lower surface of the side plate 41 on front side of the first transferring part 24 in the traveling direction of the intermediate transfer belt 12 and the front end portion of the extension part 51*a* of the slide member 51 is fixed on the lower surface of the side plate 41 at the first transferring part 24. They may be fixed by means of adhesion using a double-sided tape T, for example.

A regulating part 54 made of elastic material is fixed on the lower surface of each side plate 41 between the adjacent seal members 50 in the traveling direction of the intermediate transferring belt 12. When the intermediate transferring belt 12 meanders, the regulating parts 54 abut with side edges of the intermediate transferring belt 12 to prevent the intermediate transferring belt 12 from being damaged.

When the image forming unit 11 is attached, the seal member 50 comes into contact with the toner image non-forming area R of the photosensitive drum 18. More specifically, as shown in FIG. 5, the slide member 51 fixed on the opposed surface 52*b* of the elastic member 52 comes into contact with the toner image non-forming area R of the photosensitive drum 18. Thereby, the elastic member 52 is compressed and the opposed surface 52*b* is deformed along the toner image non-forming area R and presses the slide member 51 against the toner image non-forming area R. Still further, a very narrow gap is made between the extension part 51*a* of the slide member 51 and the toner image non-forming area R.

In the color printer 1 constructed as described above, the spaces between the toner image non-forming areas R of the photosensitive drum 18 and the lower surfaces of the pair of side plates 41 of the intermediate transfer unit 13 are sealed by the seal members 50. Therefore, even if toner scatters from the developing unit 16 during the image forming operation of each of the image forming units 11, the scattered toner is prevented from flowing in the downstream space in the rotating direction of the photosensitive drum 18 beyond the first transferring part 24.

Depending on surface property of the toner image non-forming area R of the photosensitive drum 18, a friction between the toner image non-forming area R and the slide member 51 increases and the slide member 51 may be pulled in the rotating direction of the photosensitive drum 18 as the photosensitive drum 18 rotates. In a case of an amorphous silicon photosensitive drum in particular, an element pipe having property of high friction with the slide member may be used. If the opposed surface 52*b* in contact with the toner image non-forming area R is pulled, the elastic member 52 deforms such that the upstream side end surface 52*c* is pulled toward the surface of the photosensitive drum 18, as shown by an arrow in FIG. 6. However, even if the elastic member 52 is thus deformed, the elastic member 52 will not come into contact directly with the toner image non-forming area R of the photosensitive drum 18 because the slide member 51 fixed on the upstream side end surface 52*c* of the elastic member 52 comes into contact with the toner image non-forming area R.

Still further, in the case where the elastic member 52 is deformed in the rotating direction of the photosensitive drum 18, the deformation of the elastic member 52 is reduced because the extension part 51*a* braces the elastic member 52 from a direction opposite to the rotating direction of the photosensitive drum 18.

As described above, according to the color printer 1 of the present disclosure, because the seal member 50 prevents the toner scattered from the developing unit 16 from flowing into the downstream side space in the rotating direction of the photosensitive drum 18 beyond the first transferring part 24, an eliminating failure caused by the scattered toner adhered on the static eliminator 20 can be prevented.

Still further, even if the slide member 51 is pulled in the rotating direction of the photosensitive drum 18 and the elastic member 52 is deformed, no trouble such as abnormal sound generated from the seal member 50 is occurred because the slide member 51 always comes in contact with the toner image non-forming area R of the photosensitive drum 18. Accordingly, it is possible to reliably seal the scattered toner and also to prevent the trouble such as the abnormal sound from being generated.

In a case where an amorphous silicon photosensitive drum is used as the photosensitive drum 18, a friction between the toner image non-forming area R and the seal member 50 is likely to increase and the seal member 50 is therefore easy to be deformed. However, by using the seal member 50 according to the present disclosure, the slide member 51 can always come in contact with the toner image non-forming area R even if the elastic member 52 is deformed. Accordingly, it become possible to prevent the toner from leaking into the downstream space in the rotating direction of the photosensitive drum 18 through the toner image non-forming area R while preventing the abnormal sound from being generated.

Accordingly, even if the static eliminator 20 is disposed on the downstream side from the first transferring part 24 in the rotating direction of the photosensitive drum, no problem such as insufficient light quantity of the static eliminator 20 occurs. By disposing the static eliminator 20 on the downstream side from the first transferring part 24 in the rotating direction of the photosensitive drum 18, since it becomes possible to prolong a time from a static eliminating process to a next charging process, it is also possible to suppress exposure memory, which is likely to be generated in the amorphous silicon photosensitive drum.

It is noted that the seal member 50 of the present disclosure is applicable also to a monochrome image forming apparatus.

While the preferable embodiment and its modified example of the image forming apparatus of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

What is claimed is:

1. An image forming apparatus comprising:

a rotatable image carrier;

a development device configured to form a toner image on the image carrier;

a seal member provided on a downstream side in a rotating direction of the image carrier beyond the development device and configured to prevent toner from leaking into a downstream side space that is downstream of the seal member in the rotating direction through toner image non-forming areas outside of a toner image forming area of the image carrier; and a support member, wherein the seal member includes:

an elastic member having an opposed surface facing the toner image non-forming area and an end surface continuing from an upstream side end of the opposed surface in the rotating direction and extending so as to separate from the toner image non-forming areas of the image carrier and the development device, and a slide member provided along the opposed surface and the end surface and configured to come in contact with the toner image non-forming area, the support member is configured to support the elastic member, the slide member includes an extension part extending downstream in the rotating direction beyond the elastic member, and the extension part is supported by the support member at a downstream side position in the rotating direction beyond the elastic member.

2. The image forming apparatus according to claim 1, wherein the elastic member includes an attachment surface configured to be attached on a lower surface of the support member and the end surface is formed so as to be perpendicular to the attachment surface.

3. The image forming apparatus according to claim 1, wherein the opposed surface inclines in an obliquely upward direction toward the downstream side of the elastic member in the rotating direction and the elastic member is formed so as to be reduced in height toward the downstream side of the elastic member in the rotating direction.

4. The image forming apparatus according to claim 1, wherein the support member is a pair of side plates configured to rotatably support the image carrier.

5. The image forming apparatus according to claim 1, wherein the image carrier is an amorphous silicon photosensitive drum.

6. The image forming apparatus according to claim 1, further comprising:

an intermediate transferring belt on which the toner image formed on the image carrier is transferred;

a static eliminator provided on the downstream side from the intermediate transferring belt in the rotating direction and configured to remove residual electric charge on a surface of the image carrier member after the toner image is transferred onto the intermediate transferring belt; and a cleaning device provided on the downstream side from the static eliminator in the rotating direction and configured to remove residual toner on the surface of the image carrier after the toner image is transferred onto the intermediate transferring belt.

* * * * *